US006052840A

United States Patent [19]

West et al.

[11] Patent Number: 6,052,840

[45] Date of Patent: Apr. 25, 2000

[54] TOILET TRAINING ACCESSORY

[76] Inventors: Michael K. West, 104 Gay Gayle Terrace; Charles R. West, 2937 S. Atlantic, #1509, both of Daytona Beach Shores, Fla. 32118; David R. West, 2590 Ginger Dr., Buford, Ga. 30519; Bradley R. West, 1640 Highland Farm, Suwana, Ga. 30024

[21] Appl. No.: 09/149,995

[22] Filed: Sep. 9, 1998

[51] Int. Cl.[7] ..... E03D 9/00

[52] U.S. Cl. ..... 4/300.3; 4/483

[58] Field of Search ..... 4/300.3, 239, DIG. 5, 4/483, 479

[56] References Cited

U.S. PATENT DOCUMENTS

| | | | |
|---|---|---|---|
| 2,388,856 | 11/1945 | Lewis | 4/239 |
| 2,411,137 | 11/1946 | Neufeld | 155/31 |
| 2,446,381 | 8/1948 | Middleton | 4/239 |
| 2,676,331 | 4/1954 | Inman | 4/239 |
| 2,791,780 | 5/1957 | Krischer | 4/DIG. 5 |
| 2,980,919 | 4/1961 | Otto et al. | 4/1 |
| 3,071,778 | 1/1963 | Renshaw | 4/1 |
| 3,341,867 | 9/1967 | Keen | 4/239 |
| 3,914,803 | 10/1975 | Gregovski | 4/1 |
| 3,931,649 | 1/1976 | Jankowski | 4/1 |
| 4,348,776 | 9/1982 | Sarjeant | 4/300 |
| 4,381,568 | 5/1983 | Brown | 4/239 |
| 4,612,676 | 9/1986 | Whitman | 4/300.4 |
| 5,117,512 | 6/1992 | Bressler | 4/300 |
| 5,276,925 | 1/1994 | Blaha | 4/300.4 |

*Primary Examiner*—Henry J. Recla
*Assistant Examiner*—Huyen Le
*Attorney, Agent, or Firm*—Lucian Wayne Beavers Waddey & Patterson

[57] ABSTRACT

The present invention relates to toilet training aids. The invention is a training aid which includes a training seat and a stand-up trainer. One embodiment of the training aid includes a child sized toilet seat. The seat defines a seat opening therein. A back extends upward from and away from the seat opening. And a plurality of sides depends from the back, the sides and the back forming a hooded splash guard having a target opening facing away from the seat, the splash guard adapted to direct fluid toward the toilet.

23 Claims, 3 Drawing Sheets

TOILET TRAINING ACCESSORY

BACKGROUND OF THE INVENTION

The present invention relates generally to toilet accessories for facilitating use of a commode or portable toilet. More particularly, this invention pertains to a toilet training aid to train children how to use a toilet and to reduce mess during the training process.

Numerous toilet training seats have been invented. None however aid in training how to use a toilet while standing, e.g. when a boy is urinating from a standing position. Many inventions pertaining to splash guards exist to reduce the area that urine spreads when it is not effectively directed toward a toilet bowl. The vast majority of these are shields located near the back of the toilet rim. The idea is that the urine hits the shield and runs down the front of it into the toilet bowl. There are numerous disadvantages with these types, including the fact many are cumbersome to install and remove as well as unsightly and awkward when left in place. Nor do they generally offer an effective "training" aid because the "target" presented is on the back of the toilet. This may lead little ones to "aim high," thereby training them to overshoot the bowl. Finally, none of the previous training devices combine a seat with a "stand-up" training aid.

It should be noted that children are not the only ones in need of a stand-up training or targeting aid. Mentally retarded persons, handicapped persons, and persons suffering from lost, or deficient, motor control would benefit from a device which helps to direct urine delivered from a standing position to the bowl. Many of these individuals, including toddlers, would also benefit from a toilet seat with added lateral support.

A device that solves many of these messy, awkward, and embarrassing problems and one that combines a training seat with a stand-up trainer is lacking in the prior art.

What is needed, then, is a device that is simple, easy to use, and will aid toilet training, particularly training to use of a toilet from a standing position. A simple device to reduce mess due to errant use of a toilet is needed. A portable commode which combines these needed features would also be useful. A device capable of facilitating lateral support of a commode user that incorporates the aforementioned features is lacking, and is needed for the aforementioned reasons.

In particular, a toilet accessory which is comfortable and sized for a child and combines a toilet training seat with a stand-up trainer is needed both for the sake of the child and the parents, or caretakers. The needed device should also reduce errant urine spray from between a toilet seat and a toilet rim.

SUMMARY OF THE INVENTION

The present invention relates generally to toilet accessories for facilitating use of a commode or portable toilet. More particularly, this invention pertains to a toilet training aid to train children how to use a toilet and to reduce mess during the training process, including training how to use the toilet from a standing position.

The invention, a toilet accessory, also referred to herein as a toilet training seat, is a combination child toilet seat and training aid. This product rests securely on the top of either the rim of a toilet bowl or a standard toilet seat already attached to the toilet bowl. The toilet accessory can be removed easily to allow normal use of a commode.

In one embodiment the toilet training aid includes a child sized toilet seat and a hooded splash guard including a stand-up target opening. The seat includes a seat opening therein sized for a child. A pair of support sides extend upward on either side of the seat opening. A back extends upward from and away from the seat opening. A plurality of sides depends from the back, the sides and the back forming the hooded splash guard. The hooded splash guard includes the target opening that faces away from the seat. The splash guard is also adapted to direct fluid toward the toilet. A support flange extending from the seat is adapted to removably engage a toilet, typically a toilet seat or a toilet rim. The support flange may also be adapted to engage a portable collection base, or basin. The toilet accessory generally also includes a drop funnel extending downward from the seat opening toward the toilet.

Another embodiment of the invention includes a seat adapted to removably engage a commode. The seat has a front and a back. The seat defines a seat opening between the front and the back such that when the seat engages the commode, the seat opening is over the toilet bowl. The invention also includes a urine targeting means for directing urine delivered from a standing position into the commode. The targeting means includes a hood sloping upward and away from the seat. The hood defines a hood opening for receiving and directing the urine into the toilet bowl.

Several objectives of the invention are apparent from its teachings. One object of the present invention is to provide a simple, easy to use device that will aid toilet training, particularly use of a toilet from a standing position.

Another object of the present invention is to provide a simple device to reduce mess due to errant use of a toilet.

Another object of the present invention is to provide a collection base for use closer to the ground than a standard commode. A further object of the base is to provide, in combination with the lower to the ground capability, a step to reach a standard commode.

Another object of the present invention is to provide a portable commode.

Another object of the present invention is to provide a device capable of facilitating lateral support of a commode user.

Another object of the present invention is to provide a toilet accessory that is comfortable and sized for a child.

A further object of the present invention is to provide a device which reduces errant urine spray from between a toilet seat and a toilet rim. Other objects of the invention will be readily apparent to those skilled in the arts.

DESCRIPTION OF THE PREFERRED EMBODIMENTS

Figure 1:
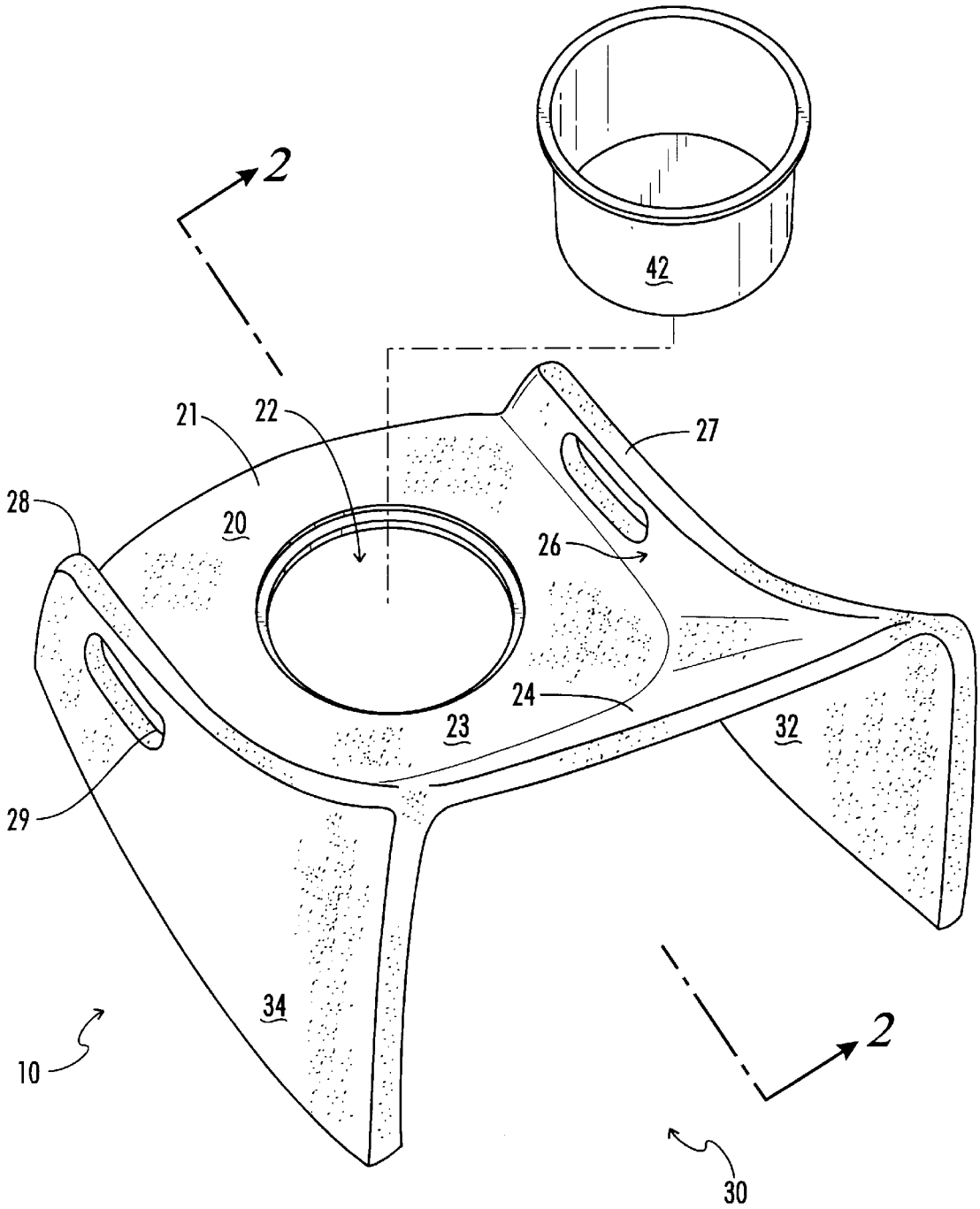
FIG. 1 shows a perspective view of the toilet accessory.

Applicant's invention will be best understood when considered in light of the following description of the preferred embodiments of the invention, as illustrated in the attached drawings wherein like reference numerals and characters refer to like parts.

Figure 2:
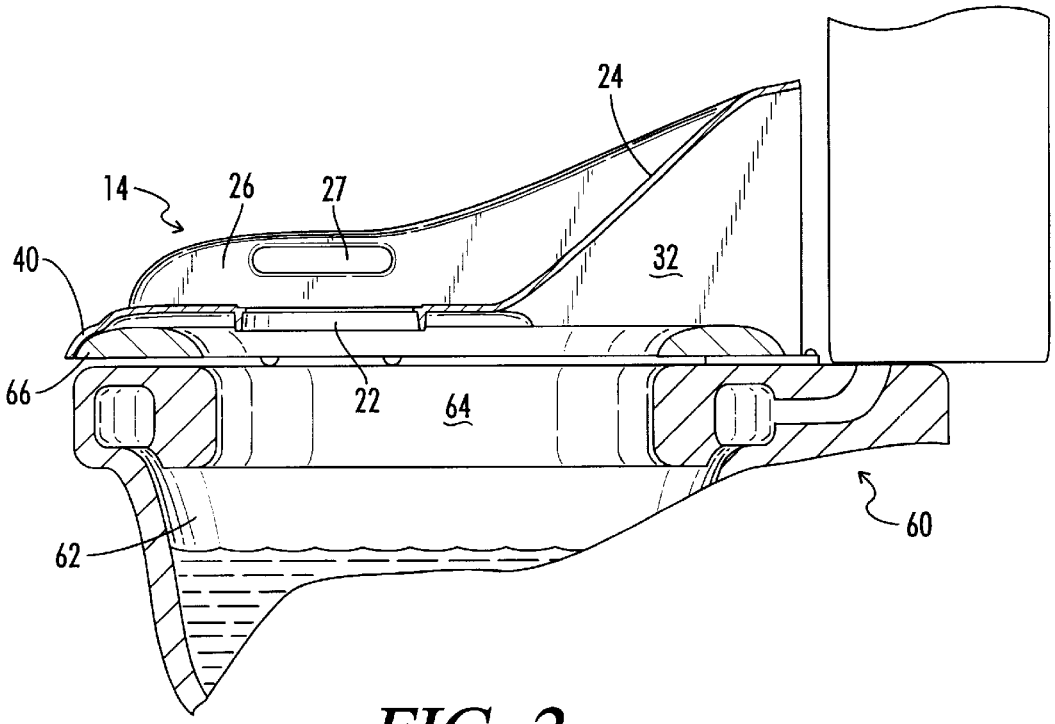
FIG. 2 shows an elevated sectioned view of the toilet accessory in a first position.
Figure 3:
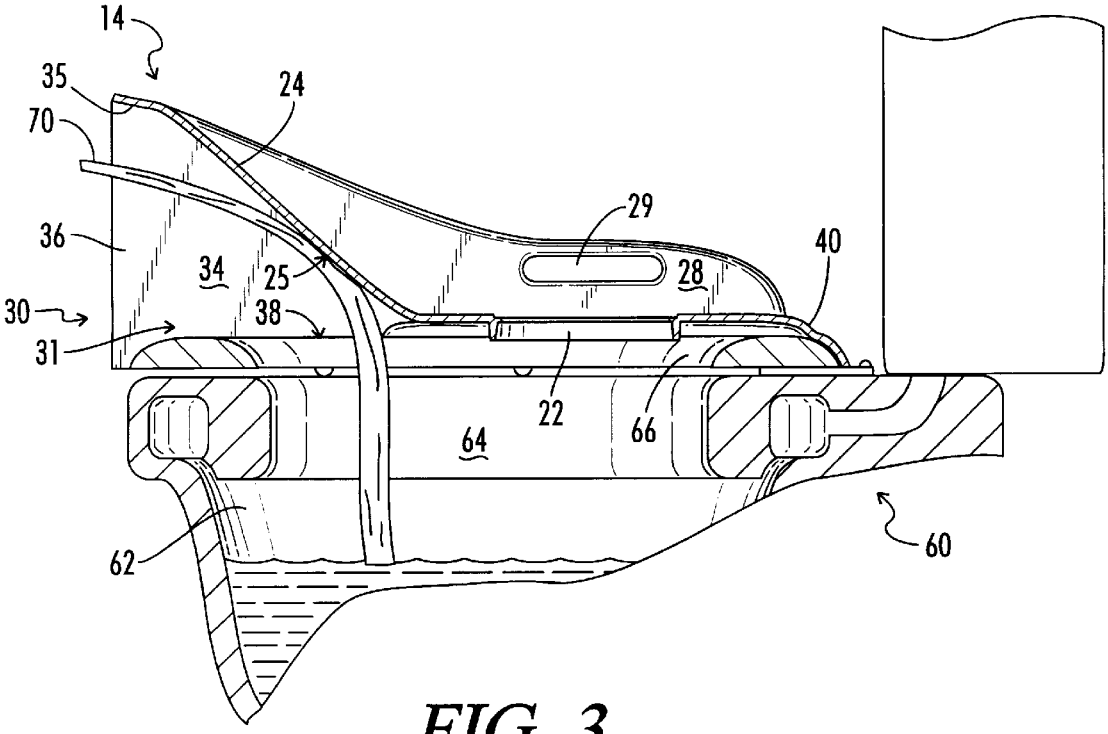
FIG. 3 shows an elevated sectioned view of the toilet accessory in a second position.
Figure 4:
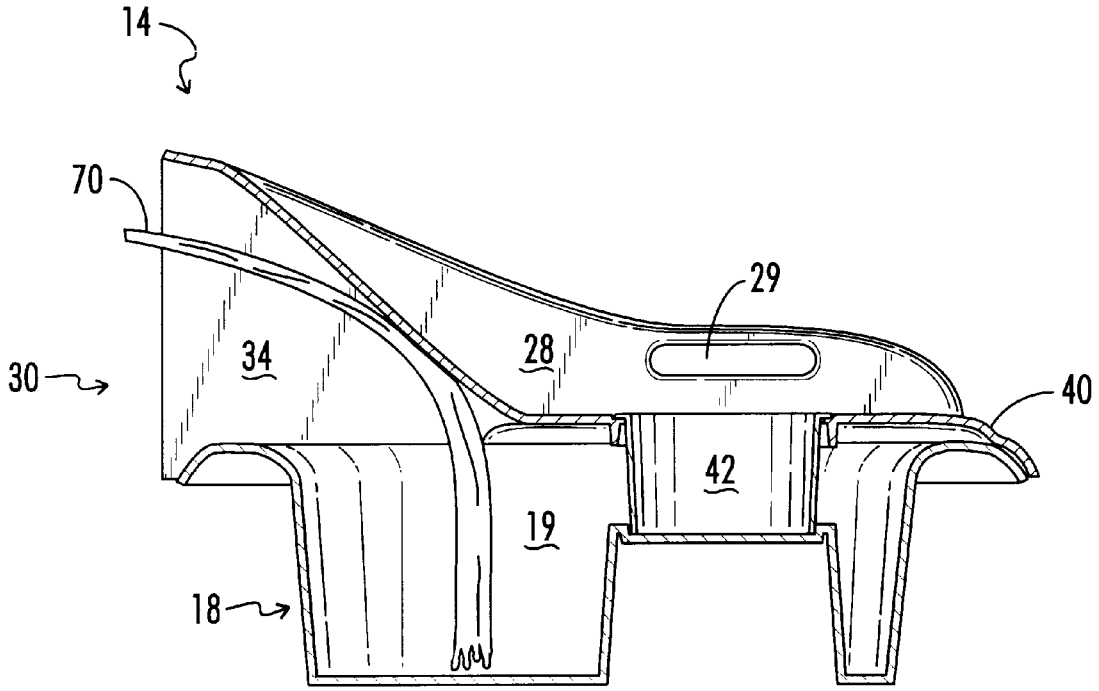
FIG. 4. shows an elevated sectioned view of the toilet accessory in use with a base.

FIG. 1 shows a perspective view of a toilet accessory 10. FIGS. 2 through 4 show another embodiment of the toilet training aid 14. FIG. 1 more clearly shows a seat 20 than FIG. 2 or 3. Typically the seat will be a child sized seat defining an opening 22 sized to accommodate a toddler or small child. The seat 20 also includes a front 21 and a rear 23. Support sides 26 and 28 extend upwardly on either side of the seat opening 22. A back 24 extends upward and away from the seat rear 23. The seat back 24 forms a urine targeting means 30. The urine targeting means 30, or stand-up target aid 30, typically includes a hood 35. The hood 35 slopes upward and away from the seat 20. The hood 35 defines a hood opening 36, or target opening 36. This is shown more clearly in FIG. 3 along with a pair of sides 32 and 34 extending away from the seat 20.

A splash guard 25, as seen in FIG. 3, is contained within the stand-up target aid 30. Typically the splash guard 25, or splash shield 25, is the opposite side of back 24. The sides 32 and 34 generally also depend from the splash guard 25 and form the hood 35.

The plurality of sides 32 and 34 and the splash guard 25 also form a chamber 31. The chamber 31 includes the target opening 36, best seen in FIG. 3, and a bowl opening 38. This allows the urine 70 directed toward the target opening 36 to be directed by means of the splash guard 25 toward the bowl opening 38 into a bowl or toilet bowl 62. The sides 32 and 34, along with the splash shield 35, act to contain errant spray. Thus they may also collectively be considered a splash shield or a splash guard. Typically the chamber 31 will have a cross section that decreases in size as one moves from the target opening 36 towards the bowl opening 38. The cross sectional area is a function of width 37 and sides 32 and 34. The sides 32 and 34 may narrow in, or the splash guard 25 may slope down, or both, to decrease the cross section vertically as well as horizontally.

Thus the seat 20 is used in a conventional manner when the toilet accessory 10 is in a first position with the seat front 21 facing forward and the targeting means 30 is used when the toilet accessory is in a second position with the hooded opening 36 facing forward. The first position is also referred to as a first mode of operation, likewise, the second position is also referred to as a second mode of operation. In the first mode of operation, an occupant, typically a toddler, sits on the seat 20, and the seat back 24 functions as a seat back, or back support for the occupant. In the second mode of operation, the splash shield 25 functions to direct fluid delivered from a standing position toward a toilet bowl. Preferably the splash shield 25 is the reverse side of the seat back 24.

In another embodiment of the invention, a toilet training aid 14 comprises a child sized toilet seat 20 and a stand-up target aid 30 attached to the seat 20. The seat 20 defines an opening 22 therein. The stand-up target aid 30 comprises a splash shield 25 attached to the seat 20 behind the seat opening 22 and extending upwardly away from the seat 20. A plurality of sides 32 and 34 extend away from the seat 20. The splash shield 25 and the plurality of sides 32 and 34 form a chamber 31 having a target opening 36 spaced away from the seat 20 and a bowl opening 38 proximate, or near, the seat opening 22. Thus, urine 70 directed at the target opening 36 is directed, or redirected, toward the toilet bowl 62.

FIG. 2 shows the toilet accessory 14 in a first position where the seat 20 shown is used in a conventional manner. FIGS. 2, 3, and 4 show the invention cut along a section-line equivalent to section line 2—2 shown in FIG. 1. The seat front 21 is facing forward, i.e. in the first position. Flanges 40 support the seat on toilet seat 66. In alternative embodiments the flange 40 is also adapted to support the seat 20, and therefore the training aid 14, on a toilet rim 64 or a base 18.

FIG. 3 shows the training aid 14 in a second position where the stand-up target aid 30 is facing forward. This allows urine 70 to be directed toward the target opening 36 from a standing position.

FIG. 4 shows the toilet training aid 14 attached to a portable collection base 18. The base 18 includes an interior 19. The seat 20, typically through the use of flanges 40, is preferably adapted to allow the toilet training aid 14 to removably attached to the toilet seat 66, the toilet rim 64, or the base 18. The seat 20 removably engages the base 18 such that the seat opening 22 is over the base interior 19 and the targeting means 30 is capable of directing urine 70 into the base 18. The toilet accessory 14 includes the collection base 18, in one embodiment. The base 18 being adapted to cooperatively engage the seat 20 in an operable manner.

FIGS. 1 and 4 show a drop funnel 42. FIG. 1 shows the drop funnel 42 removed from the seat opening 22. The drop funnel may of course be sealed at the bottom, as shown in FIG. 1. Alternatively, the drop funnel 42 is open ended and used to facilitate direction of waste toward the bowl 62.

It will be apparent to those skilled in the arts that the support sides 28 and 26 may be rounded humps or raised impressions rather than protruding sides.

Other objects and features of the invention will be obvious to those skilled in the arts. For example, the drop funnel 42 also functions as a splash guard when the toilet accessory 14 is used as a conventional toilet seat. This is particularly useful for males that have not learned, or are not able, to direct urine down into the bowl 62. The drop funnel 42 will help prevent urine from being sprayed out from below the training seat 20 or the toilet seat 66 because the urine is not directed sufficiently down into the bowl 62.

As a toilet seat, the apparatus 10 or 14 functions to decrease the size of the opening in the seat of a standard toilet. This permits children to sit comfortably on the seat and decreases the likelihood of them slipping into the bowl because of their smaller size. There is a noticeable upward slope on the back side of the apparatus. This appears to be a type of back support for a child sitting on the toilet seat but actually houses the stand-up training aid component of the apparatus.

To use as a stand-up training aid, the device is rotated so that the opening in the back of the unit is facing forward. What was the front of the training toilet seat is now in the back. The opening is to train boys how to accurately direct urine into the toilet while standing. The boy can either stand on the floor or stand on the base while urinating.

From the standing position, the user can look into the opening and see the cavity of the toilet bowl. He can subsequently direct the stream of urine into the bowl through the wide opening. The device also serves as a shield which reduces or eliminates inadvertent overspray during urination. All urine is directed into the bowl. This feature eliminates urine being directed onto the back of the toilet, underneath the toilet tank, onto the walls behind the toilet or onto the floor. A lower section can be used to catch underspray, shooting short, or drops.

The device can also be used in conjunction with a separate base which permits the child to sit closer to the floor. The device 10 or 14 sits securely on the base. The base and seat combination is lower than a standard toilet and more readily accommodates the shorter legs of a child. The base has a removable collection bowl that allows easy disposing of wastes and subsequent cleaning.

The base can also be turned over to provide a step up to the standard toilet. This flat surface permits a child to step up to sit on the toilet and to stand up to step down without there being a significant difference between toilet height and leg length.

The invention has been most particularly described relative to toilet training and child size seats, but it will be apparent to those skilled in the art that the device, particularly the portable device, may be used in other situations such as camping. Also the device will find uses for aiding individuals with diminished motor skills as has been discussed previously.

Thus, although there have been described particular embodiments of the present invention of a new and useful Toilet Training Accessory, it is not intended that such references be construed as limitations upon the scope of this invention except as set forth in the following claims.

What is claimed is:

1. A toilet accessory for facilitating use of a commode having a toilet bowl and having a toilet seat, the toilet accessory comprising:

a training seat adapted to removably engage the commode, the training seat having a seat front and a seat rear, and defining a training seat opening between the training seat front and the training seat rear such that when the toilet accessory engages the commode the training seat opening is over the toilet bowl; and urine targeting means for directing urine delivered from a standing position into the toilet bowl, the targeting means including a hood sloping upward and away from the training seat, the hood defining a hood opening for receiving and directing the urine into the toilet bowl.

2. The toilet accessory of claim 1, wherein the hood slopes upward from the training seat rear; and the hood opening opens away from the training seat front.

3. The toilet accessory of claim 2, being sized to accommodate a toddler, including the training seat opening being sized to prevent a toddler from slipping through the seat opening.

4. The toilet accessory of claim 2, wherein the hood includes a pair of sides extending downwardly and further defining the hood opening.

5. The toilet accessory of claim 4, further comprising a pair of support sides extending upward from the training seat.

6. The toilet accessory of claim 5, wherein one of the pair of support sides comprises a handle.

7. The toilet accessory of claim 5, further comprising a drop funnel extending downward from the training seat opening.

8. The toilet accessory of claim 7, wherein the drop funnel is removable from the training seat.

9. The toilet accessory of claim 7, further comprising a portable collection base having an interior, the training seat removably engaging the base such that the seat opening is over the base interior and the targeting means is capable of directing urine into the base.

10. The toilet accessory of claim 9, sized to accommodate a toddler such that the training seat opening is sized to prevent a toddler from slipping through the training seat opening.

11. The toilet accessory of claim 1, further comprising a portable collection base having a base interior, the training seat removably engaging the base such that the training seat opening is over the base interior and the targeting means is capable of directing urine into the base.

12. The toilet accessory of claim 1, further comprising a drop funnel extending downward from the training seat opening.

13. A toilet training aid comprising a child sized toilet training seat capable of accommodating a toddler in a sitting position, the training seat defining a seat opening therein sized to prevent a toddler from slipping through the seat opening, and a stand-up target aid attached to the training seat.

14. The toilet training aid of claim 13, wherein the stand-up target aid comprises:

a splash shield attached to the training seat behind the seat opening and extending upwardly away from the seat;

a plurality of sides attached to the splash shield and extending away from the training seat; and the splash shield and the plurality of sides forming a chamber having a target opening spaced away from the training seat and a bowl opening proximate the training seat opening.

15. The toilet accessory of claim 14, wherein the chamber comprises a cross section which decreases in size moving from the target opening toward the bowl opening.

16. The toilet accessory of claim 14, wherein the stand-up target aid further comprises a lower splash guard connecting the sides proximate the target opening.

17. The toilet training aid of claim 13, further comprising:

the training seat including a training seat back attached to the training seat behind the training seat opening and extending upwardly away from the training seat;

the stand-up target aid including a splash shield, wherein the splash shield is an opposite side of the training seat back; and wherein the toilet training aid is reversible between a first mode of operation and a second mode of operation wherein the training seat back functions as a back support for an occupant sitting on the seat when the toilet training aid is operated in the first mode of operation, and wherein the splash shield directs fluid toward a toilet when the toilet training aid is operated in the second mode of operation.

18. The toilet accessory of claim 13, further comprising a pair of support sides extending upwardly on either side of the training seat opening.

19. The toilet accessory of claim 18, wherein each support side comprises a handle.

20. The toilet accessory of claim 13, further comprising a portable collection base adapted to cooperatively engage the training seat in an operable manner.

21. The toilet accessory of claim 20, wherein the training seat includes a flange adapted to engage a commode.

22. The toilet accessory of claim 13, further comprising a drop funnel extending downward from the training seat opening.

23. A toilet training aid comprising:

a child sized toilet seat, the seat defining a seat opening therein;

a pair of support sides extending upward on either side of the seat opening;

a back extending upwards from and away from the seat opening;

a plurality of sides depending from the back, the sides and the back forming a hooded splash guard having a target opening facing away from the seat, the splash guard adapted to direct urine;

a support flange supporting the seat, the support flange adapted to removably engage a toilet; and a drop funnel extending downwards from the seat opening downward.

* * * * *